US005487517A

United States Patent [19]

Smith

[11] Patent Number: 5,487,517

[45] Date of Patent: Jan. 30, 1996

[54] REMOVABLE HANGER

[76] Inventor: Harold C. Smith, 1101 Birchcrest Rd., Bellevue, Nebr. 68005

[21] Appl. No.: 353,440

[22] Filed: Dec. 9, 1994

Related U.S. Application Data

[63] Continuation-in-part of Ser. No. 77,291, Jun. 15, 1993, Pat. No. 5,395,080.

[51] Int. Cl.[6] ..... A47B 96/06

[52] U.S. Cl. ..... 248/215; 47/67; 47/39; 248/304; 248/312.1

[58] Field of Search ..... 248/214, 215, 248/340, 339, 692, 690, 304, 303, 301

[56] References Cited

U.S. PATENT DOCUMENTS

| | | | |
|---|---|---|---|
| D. 279,450 | 7/1985 | Chap | D8/363 |
| D. 296,760 | 7/1988 | McGrath | D8/373 |
| D. 300,302 | 3/1989 | Possemato | D8/367 |
| 829,239 | 8/1906 | Thompson et al. | 248/215 |
| 895,047 | 8/1908 | Schraudner | 248/215 |
| 1,036,945 | 8/1912 | Wilkerson . | |
| 1,333,692 | 3/1920 | Wester . | |
| 2,291,966 | 8/1942 | Joseph | 248/215 |
| 2,625,353 | 1/1953 | Henry | 248/48.2 |
| 2,764,384 | 9/1956 | Kirsch | 248/340 X |
| 3,043,546 | 7/1962 | Reich | 248/215 |
| 3,260,489 | 7/1966 | Hentzi | 248/215 |
| 3,653,624 | 4/1972 | Abel | 248/215 X |
| 3,854,689 | 12/1974 | Engels | 248/340 |
| 4,073,457 | 2/1978 | Batts | 248/340 |
| 4,258,893 | 3/1981 | Tolley | 248/441 B |
| 4,759,091 | 7/1988 | Kiss | 248/215 X |
| 4,880,133 | 11/1989 | Cullinane | 248/215 X |
| 4,895,336 | 1/1990 | Lieberman | 248/339 |
| 4,949,924 | 8/1990 | Carmody | 248/215 |
| 5,037,051 | 8/1991 | Moriello | 248/215 |
| 5,074,504 | 12/1991 | Minnick | 248/312.1 |
| 5,094,417 | 3/1992 | Creed | 248/215 |
| 5,118,059 | 6/1992 | Mainer | 248/215 |
| 5,149,036 | 9/1992 | Sheehan | 248/215 |
| 5,181,683 | 1/1993 | Smith | 248/227 |
| 5,199,678 | 4/1993 | Luebke | 248/311.2 |

*Primary Examiner*—J. Franklin Foss

*Attorney, Agent, or Firm*—Zarley, McKee, Thomte Voorhees & Sease; Mark D. Frederiksen

[57] ABSTRACT

A hanger for removable engagement with a support member includes a rigid body with a hook-shaped upper end and a lower end having a removable support attachment for supporting an article on the hanger.

2 Claims, 5 Drawing Sheets

REMOVABLE HANGER

CROSS-REFERENCE TO RELATED APPLICATION

This is a continuation-in-part application of Ser. No. 08/077,291, filed Jun. 15, 1993 now U.S. Pat. No. 5,395,080.

TECHNICAL FIELD

The present invention relates generally to removable or detachable hooks and hangers, and more particularly to an improved removable hook which may be detachably mounted on a dimensional lumber support member or on the metal support channel of a mobile home patio cover.

BACKGROUND OF THE INVENTION

With the popularity of plants for decorative and landscaping purposes, people often desire to decorate outside patios and decks by hanging potted plants. Due to the weight of the potted plants, hanging the plants is often difficult and unreliable. Typically, potted plants are hung on overhead beams or support members by drilling a hole and directly inserting a screw hook into the wood and hanging the pot by the screw hook. Because of the weight of the potted plant, the screws can become loose and dislodged.

Another problem with inserting a screw hook directly into the wood is that it leaves a permanent hole in the wood.

Still another problem with the conventional screw hook is that it is often not convenient to move the location of the plant because this requires removing the screw hook and inserting a new screw hook at another location.

It is common for mobile homes to utilize a metal awning with metal channel supports, which are sized differently than, dimensional lumber, thereby making conventional hooks sized for dimensional lumber inoperable on such a metal awning.

SUMMARY OF THE INVENTION

It is therefore a general object of the present invention to provide an improved removable hanger for hanging potted plants on overhead beams, handrails, and other support members.

Yet another object of the present invention is to provide a removable hanger that is easily moved from one location to another.

Still another object is to provide a removable hanger with detachable accessories for supporting various different types of articles, such as flower pots and hanging plants.

A further object of the present invention is to provide a removable hanger which is removably attachable to both dimensional lumber and conventional metal channel used in mobile home patio roofs.

These and other objects of the present invention will be apparent to those skilled in the art.

The hanger of the present invention includes a rigid body with a hook-shaped upper end adapted for removable attachment to the top surface of a support member and a lower end having a removable attachment for supporting various types of articles, such as hanging plants, flower pots, and the like.

DESCRIPTION OF THE PREFERRED EMBODIMENTS

Figure 1:
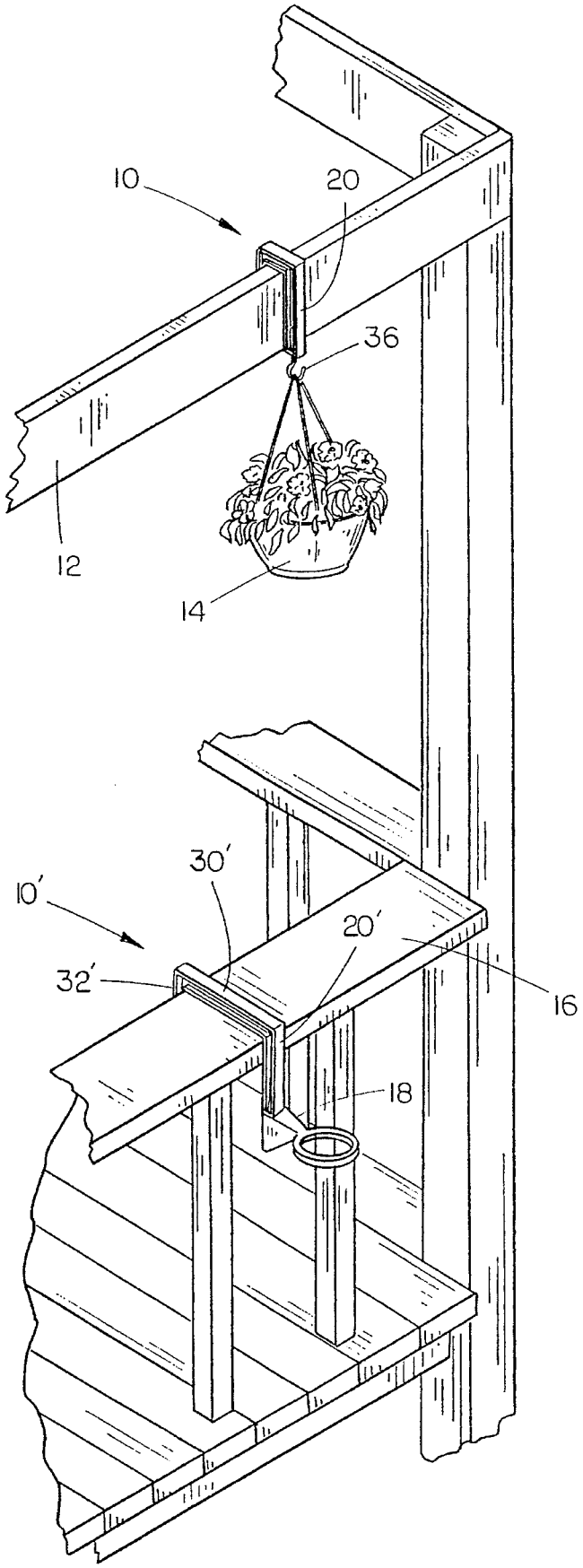
FIG. 1 is a perspective view of one embodiment of the present invention installed on a support beam and a second embodiment on a handrail.

Referring now to the drawings, in which similar or corresponding parts are identified with the same reference numeral, a first embodiment of the present invention is designated generally at 10, and is shown attached to an overhead support member 12, to support a hanging plant 14. A second embodiment of the invention is designated generally at 10', and is shown supported on a handrail 16 with a pot holder attachment 18 removably attached to hanger 10'.

Hanger 10 includes a rigid generally vertical body 20 having upper and lower ends 22 and 24, respectively. Body 20 includes a generally planar rearward surface 26 in flush abutting contact with the forward vertical surface 12*a* of support member 12.

A hook member 28 is mounted to the upper end 22 of body 26, and includes a generally horizontal arm 30 and a depending leg 32. Arm 30 extends rearwardly from upper end 22, and includes a generally planar lower surface 30*a* in flush abutting contact with the top surface 12*b* of support member 12. Leg 32 depends from the rearward end of arm 30, and includes a generally planar forward surface 32*a* in flush abutting contact with the rearward surface 12*c* of support member 12.

In order to obtain flush abutting contact between rearward surface 26, lower surface 30*a* and forward surface 32*a* of body 20, arm 30 and leg 32, respectively, with the associated surfaces of support member 12, the distance between body 20 and leg 32 is only slightly greater than the width of support member 12 (as measured between forward surface 12*a* and rearward surface 12*c*). In this way, hanger 10 is stable once it is hooked on support member 12, yet is slidable to various positions along the support member.

Figure 3:
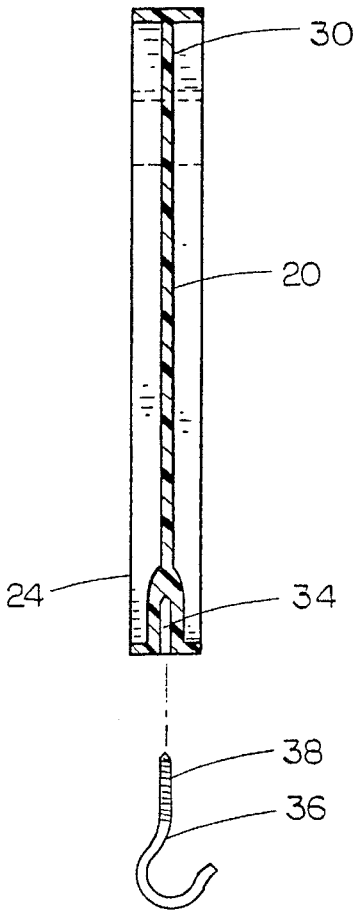
FIG. 3 is a sectional view taken at liens 3—3 in FIG. 2.
Figure 2:
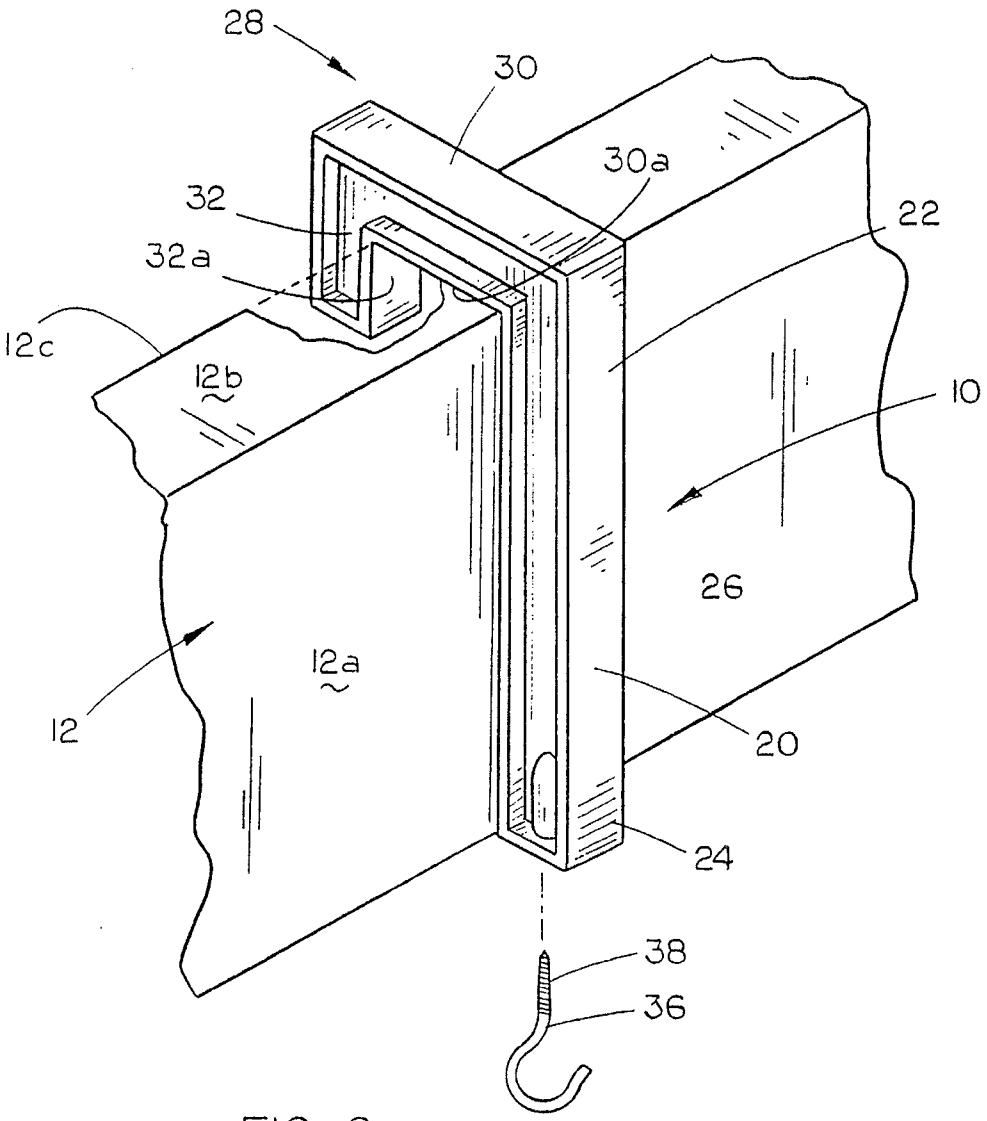
FIG. 2 is an enlarged perspective view of the first embodiment of the invention.

As shown in FIGS. 2 and 3, hanger 10 is manufactured from a rigid plastic material with an I-shaped cross-section. An interiorly threaded aperture 34 is formed in the lower end 24 of body 20 to receive a variety of support attachments. One such attachment is a conventional hook 36 having a threaded shank 38 designed for removable engagement in aperture 34. As shown in FIG. 1, hook 36 supports hanging plant 14.

Figure 4:
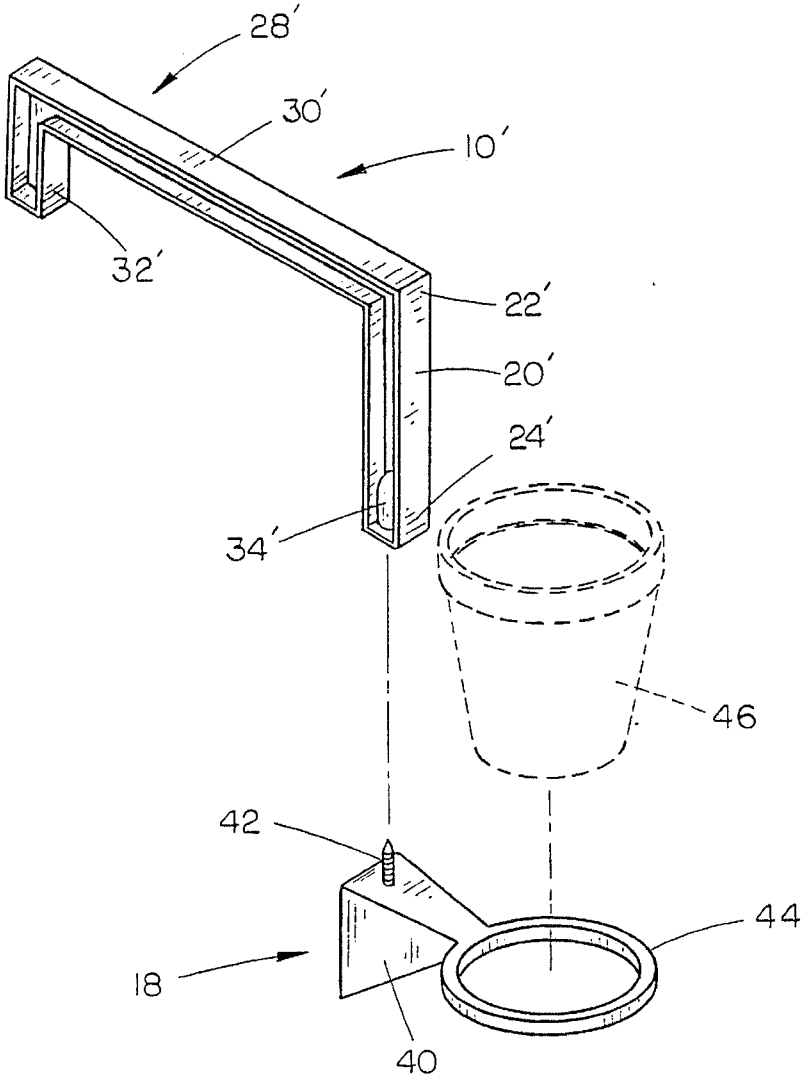
FIG. 4 is an enlarged perspective view of the second embodiment of the hanger.

A second embodiment of the invention is designated generally at 10' in FIGS. 1 and 4, and includes a generally vertical rigid body 20' with an arm 30' extending rearwardly from the upper end 22' of body 20'. A leg 32' depends from the rearward end of arm 30', to form a hook member 28' on the upper end of rigid body 20'. Hanger 10' is designed with a much longer arm 30' in order to snugly fit over the width of handrail 16, in a fashion similar to the first embodiment 10.

Pot holder attachment 18 includes a base 40 having an upwardly projecting threaded shaft 42 designed to engage aperture 34' in the lower end 24' of rigid body 20'. A horizontally oriented loop 44 is affixed to base 40 and is designed to support a flower pot 46, in a conventional fashion.

Figure 5:
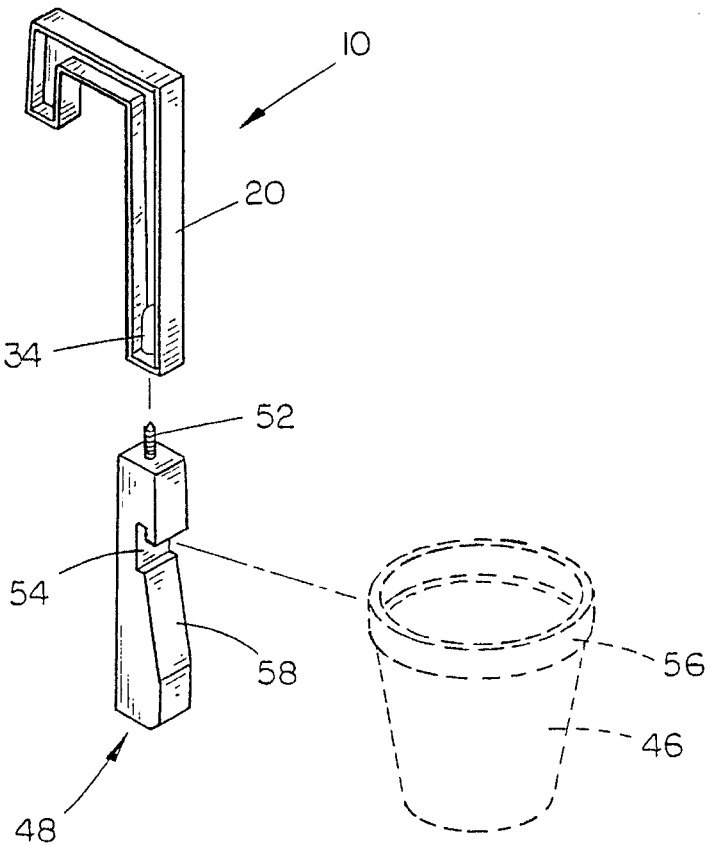
FIG. 5 is a perspective view of the first embodiment, with a different type of detachable support member.

FIG. 5 shows removable hanger 10 with a third support attachment 48 which is also designed to support a flower pot 46. Support attachment 48 includes a generally vertically oriented base 50 having an upwardly projecting threaded shaft 52 designed for removable engagement with threaded aperture 34 in rigid body 20. Base 50 includes a vertically oriented slot 54 designed to receive the annular rim 56 of flower pot 46. A sloped forward surface 58 on base 50 supports the slanted sides of flower pot 46.

Figure 6:
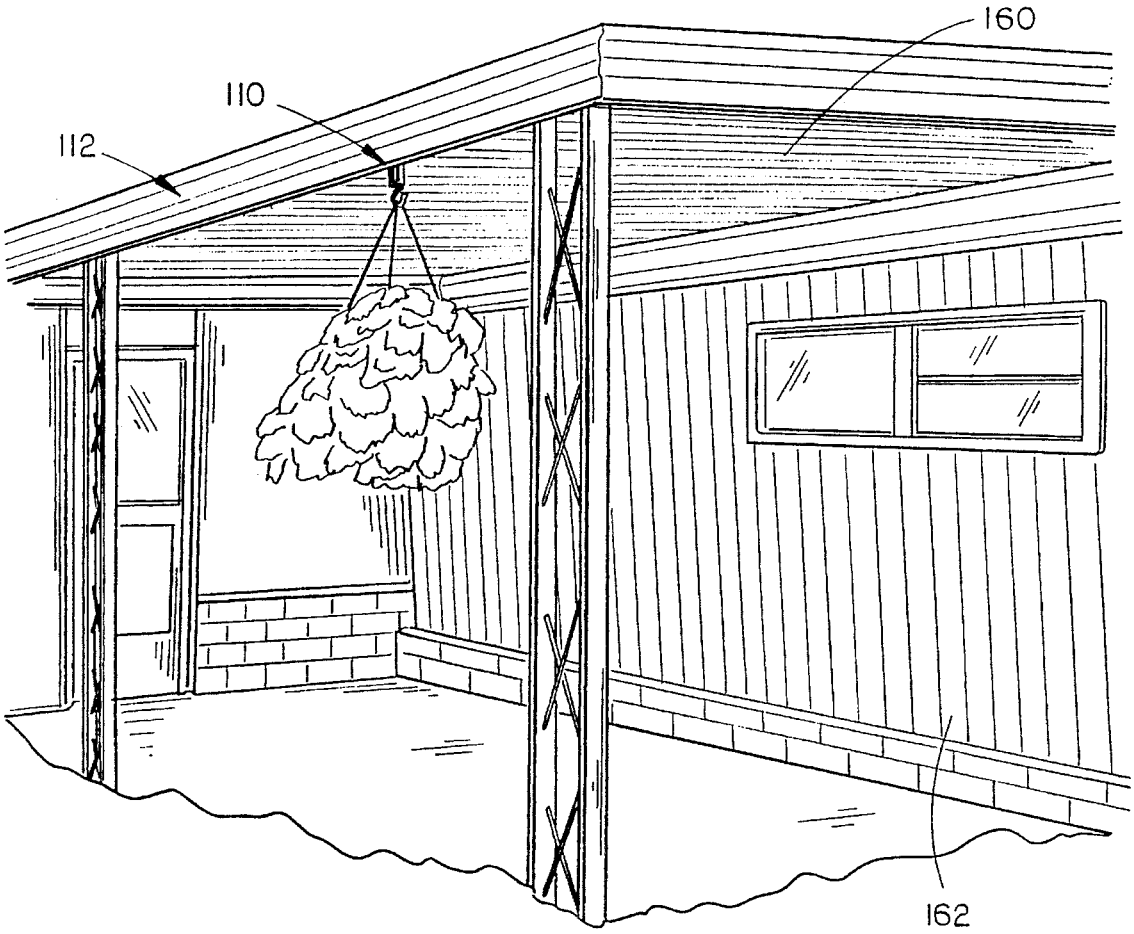
FIG. 6 is a perspective view of third embodiment of the invention installed on a metal channel support member used on a mobile home metal patio roof.

Referring now to FIG. 6, a third embodiment of the hanger is designated generally at 110 and is shown connected to a conventional metal roof awning 160 extending from a mobile home 162 or the like.

Figure 7:
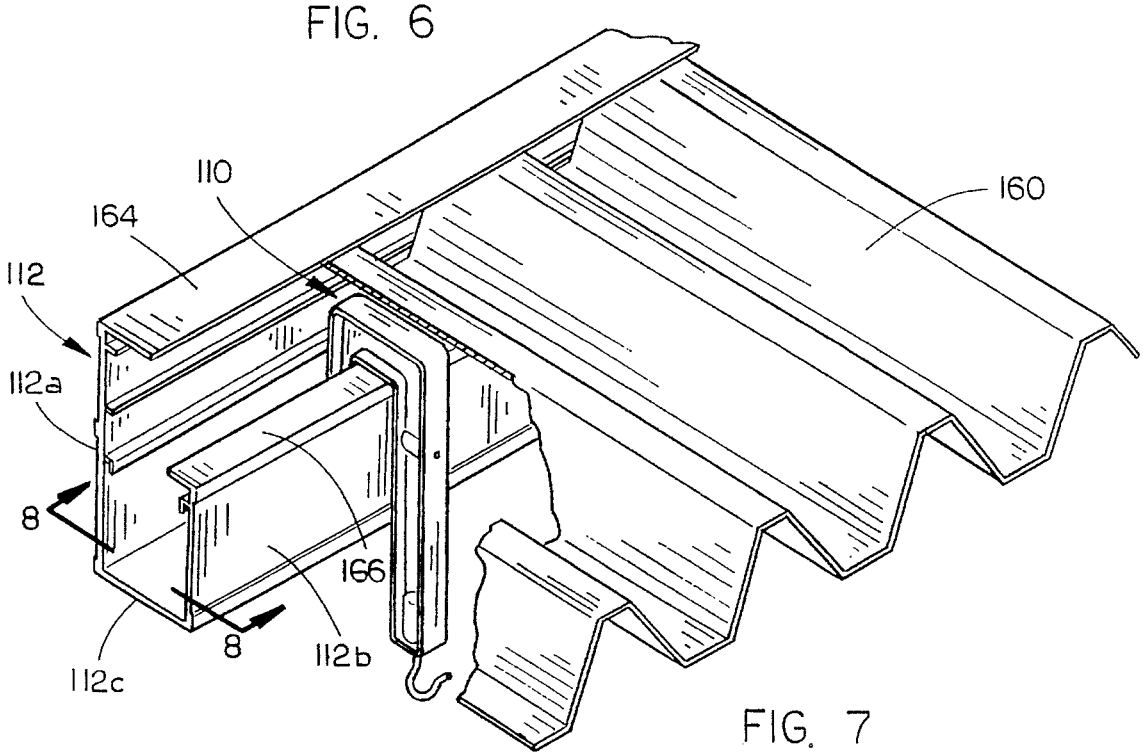
FIG. 7 is an enlarged perspective view of the hanger of FIG. 6 with portions of the metal roof removed to better show the hanger.

As shown in FIG. 7, metal roof 160 is supported by a horizontally extending metal channel 112 having a vertical forward leg **112*a*, a parallel rearward leg 112*b*, a base leg 112*c* connecting forward and rearward legs 112*a* and 112*b*, so as to form a generally reversed J-shaped channel. A flange 164 extends rearwardly from the upper end of forward leg 112, and a lower flange 166 extends forwardly from the upper end of channel rearward leg 112*b*. Flanges 164 and 166 are generally parallel and spaced apart a distance substantially equal to the thickness of roof 160**, which is journaled between the flanges for support.

Figure 9:
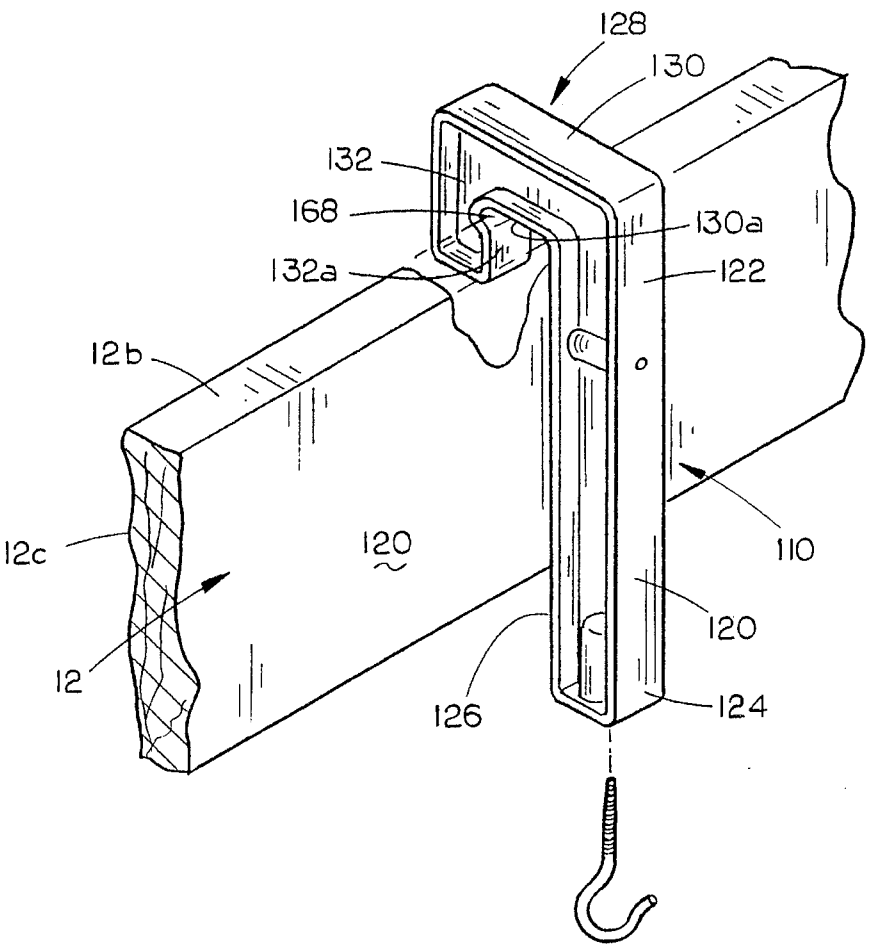
FIG. 9 is a perspective view of the third embodiment of the invention installed on a dimensional lumber support member.
Figure 8:
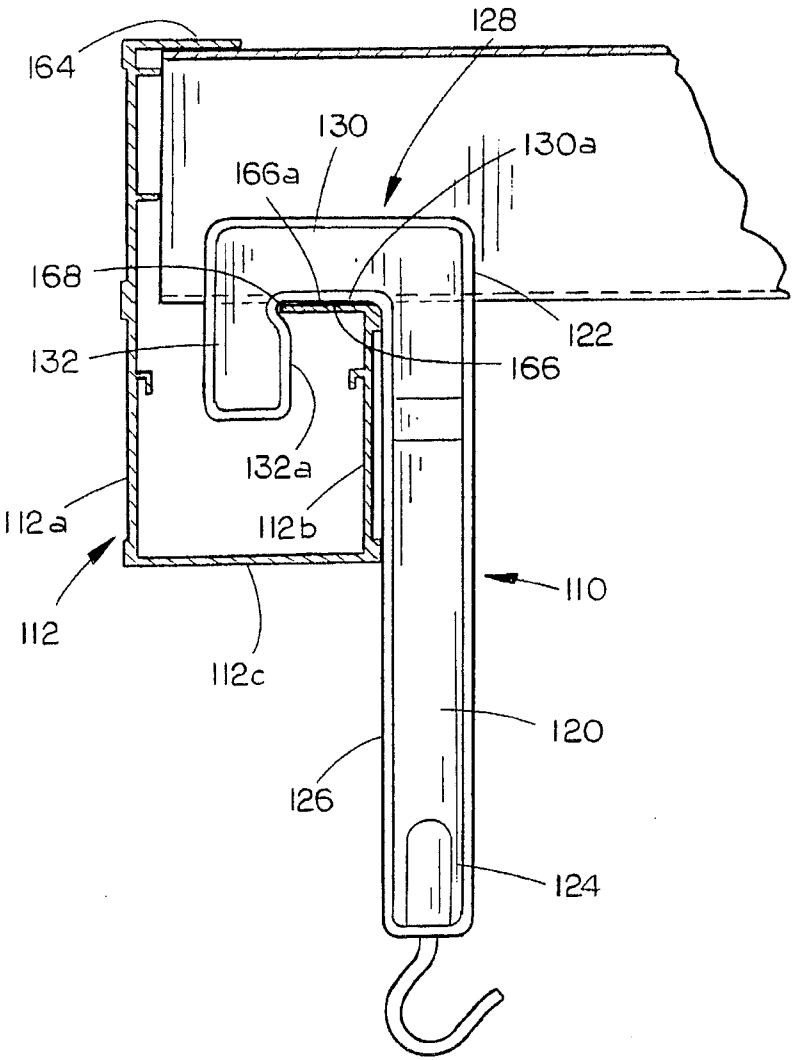
FIG. 8 is a sectional view taken at lines 8—8 in FIG. 7.

Referring now to FIGS. 8 and 9, hanger 110 includes a rigid generally vertical body 120 having upper and lower ends 122 and 124, respectively. Body 120 includes a generally planar rearward surface 126 which is designed for flush abutting contact with the forward vertical surface **12*a* of a dimensional lumber support member 12 (shown in FIG. 9). Rearward surface 126 will also contact portions of the exterior surface of leg 112*b* of channel 112, as shown in FIG. 8**.

A hook-shaped portion 128 is formed on the upper end 122 of body 126, and includes a generally horizontal arm 130 and a depending leg 132. Arm 130 extends rearwardly from upper end 122, and includes a generally planar lower surface **130*a* in flush abutting contact with the top surface 166*a* of lower flange 166, as shown in FIG. 8, or the top surface 112*b* of support member 12, shown in FIG. 9. Leg 132 depends from the rearward end of arm 130, and includes a generally planar forward surface 132*a*, oriented generally perpendicularly to lower surface 130*a* of arm 130**.

In order to obtain a flush, abutting contact between rearward surface 126, lower surface **130*a* and forward surface 132*a* of body 120, arm 130 and leg 132, respectively, with the associated surfaces of support member 12, shown in FIG. 9, the distance between body 120 and leg 132 is only slightly greater than the width of support member 12 (as measured between forward surface 12*a* and rearward surface 12*c*). In this way, hanger 110 is stable once it is hooked on support member 12**, yet is slidable to various positions along the support member.

Referring again to FIG. 8, a horizontally extending groove 168 is formed in forward surface **132*a* immediately adjacent lower surface 130*a*, having a width designed to receive the thickness of lower flange 166 therein. Preferably, the distance between forward surface 132*a* and rearward surface 126 of hanger 110 is slightly less than the width of flange 166, as measured perpendicularly from rearward leg 126. Thus, flange 166 fits snugly within groove 168, yet permits slidable movement of hanger 110 along channel 112**, as well as simple attachment and removal therefrom.

Whereas the invention has been shown and described in connection with the preferred embodiments thereof, it will understood that many modifications, substitutions and additions may be made which are within the intended broad scope of the appended claims. For example, various other types of removable support attachments may be connected to hangers 10. Such attachments may be connected to hanger 10 in many ways, beyond the threaded shaft and threaded aperture arrangement shown herein. In addition, hanger 10 may be formed of various materials in various shapes so long as the hook portion on the upper end of the rigid body is designed to snugly fit the support member to prevent rotatable movement about the longitudinal axis of the support member to which the hanger is attached.

There has therefore been shown and described an improved removable hanger which accomplishes at least all of the above stated objects.

I claim:

1. A hanger, comprising:

a rigid body having an upper and lower end and forward and rearward surfaces;

said body upper end including a hook portion for removable attachment to a support member;

said hook portion including an arm projecting rearwardly from the upper end of the body, and having upper and lower surfaces, and a leg depending from a rearward end of the arm, and having forward and rearward surfaces and opposing sides;

said arm lower surface and leg forward surface being generally flat and oriented orthogonally;

said leg forward surface having a groove formed therein extending from side to side, with an axis generally parallel to the arm lower surface, for removably receiving a projecting flange of a support member therein; and support means removably connected to the lower end of the body, for supporting an article on said hanger.

2. In combination:

a support channel having a generally "J" shaped cross-section with a a generally vertical forward short leg, a generally vertical rearward long leg, and a generally horizontal base leg connecting the forward and rearward legs;

said support channel further including a flange projecting generally horizontally and rearwardly from an upper end of the forward leg, said flange having a thickness measured from an upper to a lower surface and a width measured from the forward leg to a rearward edge; and a hanger removably engaged on said support channel, comprising: a rigid body having an upper end, a lower end and forward and rearward surfaces;

said body upper end including a hook portion removably engaging said support channel;

said hook portion including an arm projecting rearwardly from the upper end of the body, and having upper and lower surfaces, and a leg depending from a rearward end of the arm, and having forward and rearward surfaces and opposing sides;

said arm lower surface and leg forward surface being generally flat and oriented orthogonally;

said leg forward surface having a groove formed therein into which the rearward edge of said flange is slidably journaled; and support means removably connected to the lower end of the body, for supporting an article on said hanger.

* * * * *